US007342203B2

(12) United States Patent
Benoit et al.

(10) Patent No.: US 7,342,203 B2
(45) Date of Patent: Mar. 11, 2008

(54) OVEN CHAMBER INCLUDING SHIELDING MEMBER

(75) Inventors: Martin Benoit, Quebec (CA); Craig Douglass Burnett, Portland, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/230,698

(22) Filed: Sep. 20, 2005

(65) Prior Publication Data

US 2006/0081593 A1 Apr. 20, 2006

Related U.S. Application Data

(60) Provisional application No. 60/612,349, filed on Sep. 23, 2004.

(51) Int. Cl.
*A21B 1/00* (2006.01)
*F24C 1/10* (2006.01)

(52) U.S. Cl. ..... 219/402; 126/92 B

(58) Field of Classification Search ..... 219/391, 219/400, 402, 405–411; 126/90 A, 92 A, 126/92 B, 19 R See application file for complete search history.

(56) References Cited

U.S. PATENT DOCUMENTS 1,225,827 A * 5/1917 Shailor ..... 219/520
2,134,474 A 10/1938 Gillespie
2,221,595 A * 11/1940 Lockwood ..... 219/400
2,422,950 A 6/1947 Cash
2,498,583 A * 2/1950 Schulze ..... 219/403
6,008,478 A 12/1999 Crone et al.
6,121,584 A 9/2000 Key et al.
6,359,262 B1 3/2002 Robertson et al.
2002/0179587 A1 12/2002 Hui

* cited by examiner

*Primary Examiner*—Sang Paik
(74) *Attorney, Agent, or Firm*—Pearne & Gordon LLP

(57) ABSTRACT

In one example, an oven chamber has a heating element located within a first section of the oven chamber, and includes a shielding member that extends over the first section of the oven. The shielding member has an outer boundary, and one or more portions of the outer boundary are spaced away from walls of the oven chamber so as to form an open space through which convective heat is able to pass. The shielding member is supported above the heating element by support elements on which the shielding member rests and a portion of the outer boundary of the shielding member that extends away from the remainder of the shielding member to the bottom wall of the oven chamber, and the latter portion of the outer boundary of the shielding member attaches to a bracket fastened to the bottom wall of the oven chamber.

23 Claims, 3 Drawing Sheets

OVEN CHAMBER INCLUDING SHIELDING MEMBER

FIELD OF THE INVENTION

The present invention generally relates to oven chambers such as oven chambers in which food is heated. In particular, the present invention relates to oven chambers that, in addition to being able to be more readily cleaned, offer satisfactory heating and cooking characteristics.

BACKGROUND OF THE INVENTION

Many oven chambers include a heating unit, such as an electric heating element, that is located near the bottom of the oven chamber. The heating element is utilized to provide heat for the variety of functions (e.g., baking and broiling) that are carried out within the oven chamber.

It is to be appreciated that oftentimes the heating of items within the oven chamber generates a certain amount of residue. For example, residue occurs when food that is baked or otherwise cooked within the oven chamber spills, splatters, etc. Generally, much of the residue tends to fall to the bottom of the oven chamber under the influence of gravity. If the residue is not promptly removed, it can accumulate on the bottom of the oven chamber, sometimes in contact with or in close proximity to the heating element. In some instances, the spills, splatters, etc. may fall directly onto the heating element. In either case, the residue may scorch or burn and may, among other undesirable consequences, result in the creation of offensive odors and the baking of the residue onto the bottom of the oven chamber making it difficult to clean the oven chamber. Thus it is desirable to clean the residue from the oven chamber as soon as possible after it is created. However, the disposition of the heating element at the bottom of the oven chamber often makes it difficult or awkward to gain access to the residue without various complicating factors, such as the need to move the heating element.

It is known to provide a removable cover, in the nature of a protective shield or false bottom, over the bottom of the oven chamber and the heating element located thereat. However, the use of such known covers interposed between the heating element and the section of the oven chamber in which food is to be heated, may result in issues concerning the provision, distribution, etc. of heat from the heating element to that section of the oven chamber holding the items that are to be heated.

SUMMARY

In accordance with one aspect, the present invention provides an oven chamber that is aesthetically pleasing, may be more readily cleaned and offers satisfactory heating and cooking characteristics. According to one specific aspect, the oven chamber includes a bottom wall, a top wall and at least one side wall. A heating element is located within a first section of the oven chamber between the bottom wall of the oven chamber and the top wall of the oven chamber. A shielding member is located within the oven chamber between the first section of the oven containing the heating element and the top wall of the oven chamber and extends over the first section of the oven chamber, including the heating element located therein. The shielding member is essentially impervious to solid and liquid materials so as to shield the first section of the oven chamber, including the heating element located therein, from cooking and baking releases occurring in a second section of the oven chamber above the shielding member. The shielding member has an outer boundary, and one or more first portions of the outer boundary of the shielding member are spaced away from the at least one side wall of the oven chamber by a first distance so as to form an open space between each of the one or more first portions of the outer boundary of the shielding member and the at least one side wall. Convective heat is able to pass from the heating element to the second section of the oven chamber through the open spaces. Additionally, one or more second portions of the outer boundary of the shielding member are located in relation to the at least one side wall at a distance ranging from being in engagement with the at least one side wall to being spaced away from the at least one side wall a second distance that is less than the first distance. In a particular embodiment, at least one of the one or more first portions of the outer boundary of the shielding member is spaced away from the side wall of the oven chamber by a distance of about seven and two-tenths millimeters. In another particular embodiment, at least one or more of the second portions of the outer boundary of the shielding member are spaced away from the side wall of the oven chamber by a distance of about four millimeters.

According to another aspect, the oven chamber includes first and second side walls and at least one of the one or more first portions of the outer boundary of the shielding member is spaced away from the first side wall of the oven chamber so as to form an open space between the at least one of the one or more first portions of the outer boundary of the shielding member and the first side wall. Additionally, at least one of the one or more first portions of the outer boundary of the shielding member is spaced away from the second side wall of the oven chamber so as to form an open space between the at least one of the one or more first portions of the outer boundary of the shielding member and the second side wall.

According to yet another aspect, the oven chamber includes a rear wall that joins the first and second side walls. In that case, at least one of the one or more first portions of the outer boundary of the shielding member can be spaced away from the rear wall of the oven chamber so as to form an open space between the at least one of the one or more first portions of the outer boundary of the shielding member and the rear wall.

According to still another aspect, the oven chamber can have a frontal opening that provides access to the oven chamber. A portion of the outer boundary of the shielding member can be located adjacent the frontal opening of the oven chamber so as to extend away from the remainder of the shielding member toward the bottom wall of the oven chamber and rest on the bottom wall of the oven chamber so as to at least partially support the shielding member above the heating element. Additional support can be provided to the shielding member by a supporting component that can comprise support elements that are fastened to the rear wall of the oven chamber. A portion of the outer boundary of the shielding member that is adjacent the rear wall of the oven chamber rests on the support component.

According to a further aspect, an abutment member can be located at the bottom wall of the oven chamber adjacent the frontal opening of the oven chamber. In that case, the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element abuts the abutment member whereby the shielding member is retained within the oven chamber.

According to yet another aspect, a bracket can be secured to the bottom wall of the oven chamber adjacent the frontal opening of the oven chamber and inwardly of the oven chamber interior in relation to the abutment member. The bracket can include a flange that is spaced above the bottom wall of the oven chamber. With this arrangement, the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element includes a depending portion that extends inwardly of the oven chamber into the space formed between the flange of the bracket and the bottom wall of the oven.

With respect to all the foregoing aspects, at least one of the one or more second portions of the outer boundary of the shielding member can be in engagement with a side wall of the oven chamber. Additionally, the shielding member can have an upper surface that faces the second section of the oven chamber and a central portion of the upper surface of the shielding member can be disposed at a lower level within the oven chamber than the remainder of the upper surface of the shielding member. The cooking and baking releases that occur in the second section of the oven chamber tend to collect on the central portion of the upper surface of the shielding member.

BRIEF DESCRIPTION OF THE DRAWINGS

The foregoing and other features of the present invention will become apparent to those skilled in the art upon reading the description of an embodiment of the present invention that is set forth below, with reference to the accompanying drawings, in which.

DESCRIPTION OF AN EMBODIMENT OF THE INVENTION

Figure 1:
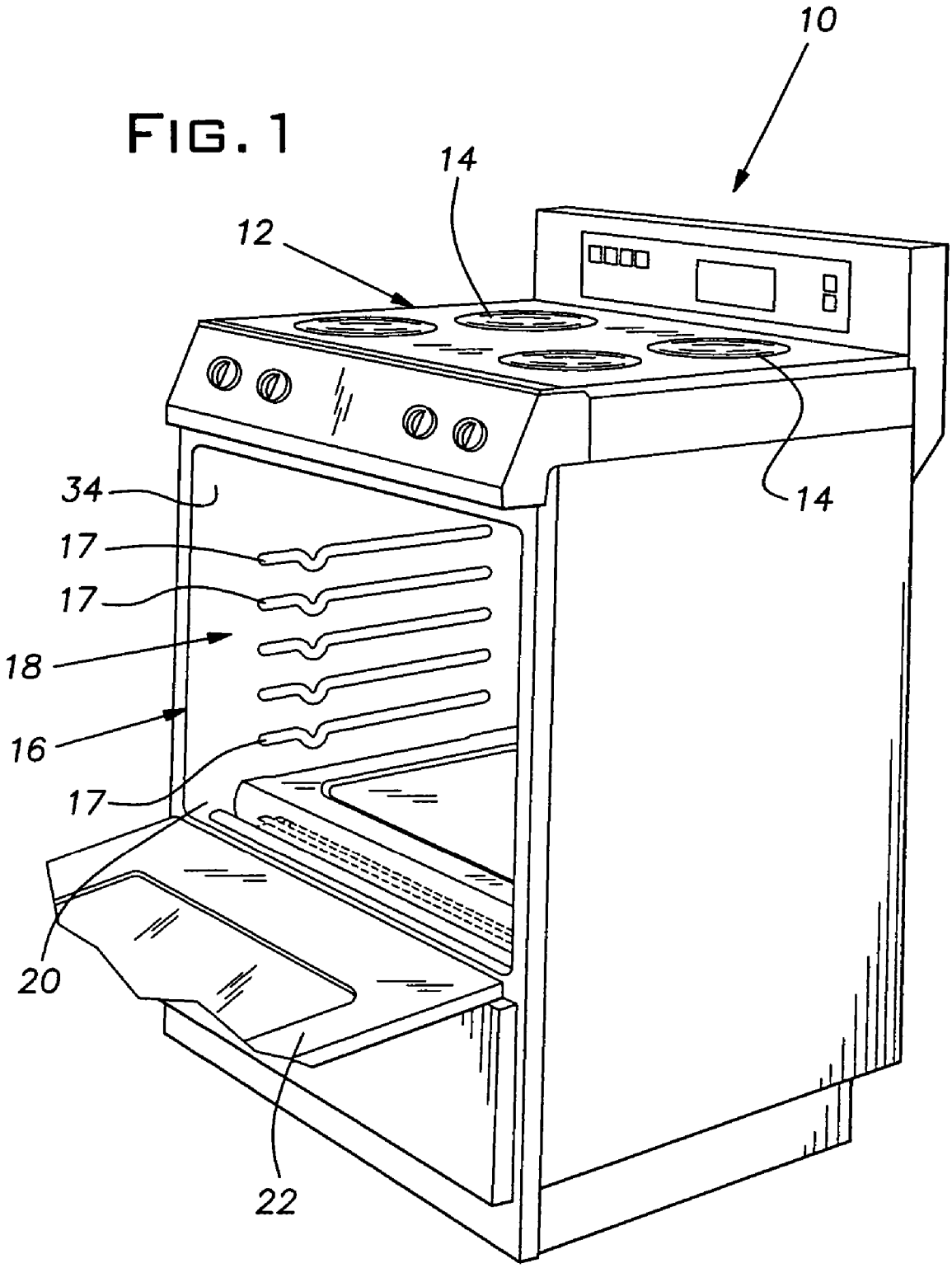
FIG. 1 is a somewhat schematic perspective view of a cooking range shown with its oven door open to illustrate one manner in which an embodiment of the shielding member of the invention can be arranged within the oven chamber of the cooking range.

Referring first to FIG. 1 of the drawings, there is shown a cooking appliance such as a range, indicated generally at 10. The appliance includes a top section, indicated generally at 12, on which are arranged several heating elements 14 on which food items may be heated, and an oven section, indicated generally at 16. The oven section 16 includes an oven chamber, indicated generally at 18, in which food items are placed and heated. For this purpose, a plurality of supports 17 of the type familiar to those skilled in the art are vertically spaced on a first side wall 34 of the oven chamber and a complementary plurality of supports, not visible in FIG. 1, are located on a second side wall of the oven chamber opposite the first side wall. Removable cooking racks (not shown) are supported by the supports 17 and serve as a resting surface for cooking wares containing food items placed on the cooking racks. The oven chamber has a frontal opening 20 through which access may be had to the interior of the oven chamber, and a door 22, a partial section of which is shown in FIG. 1, is secured to the oven section 16 by hinges, for example, and serves to open and close the frontal opening as desired. Although the oven chamber 18 of the invention is shown in the drawings as being incorporated within a cooking range, it will be appreciated that the oven chamber can be otherwise employed such as, for example, in a wall-mounted oven.

Figure 2:
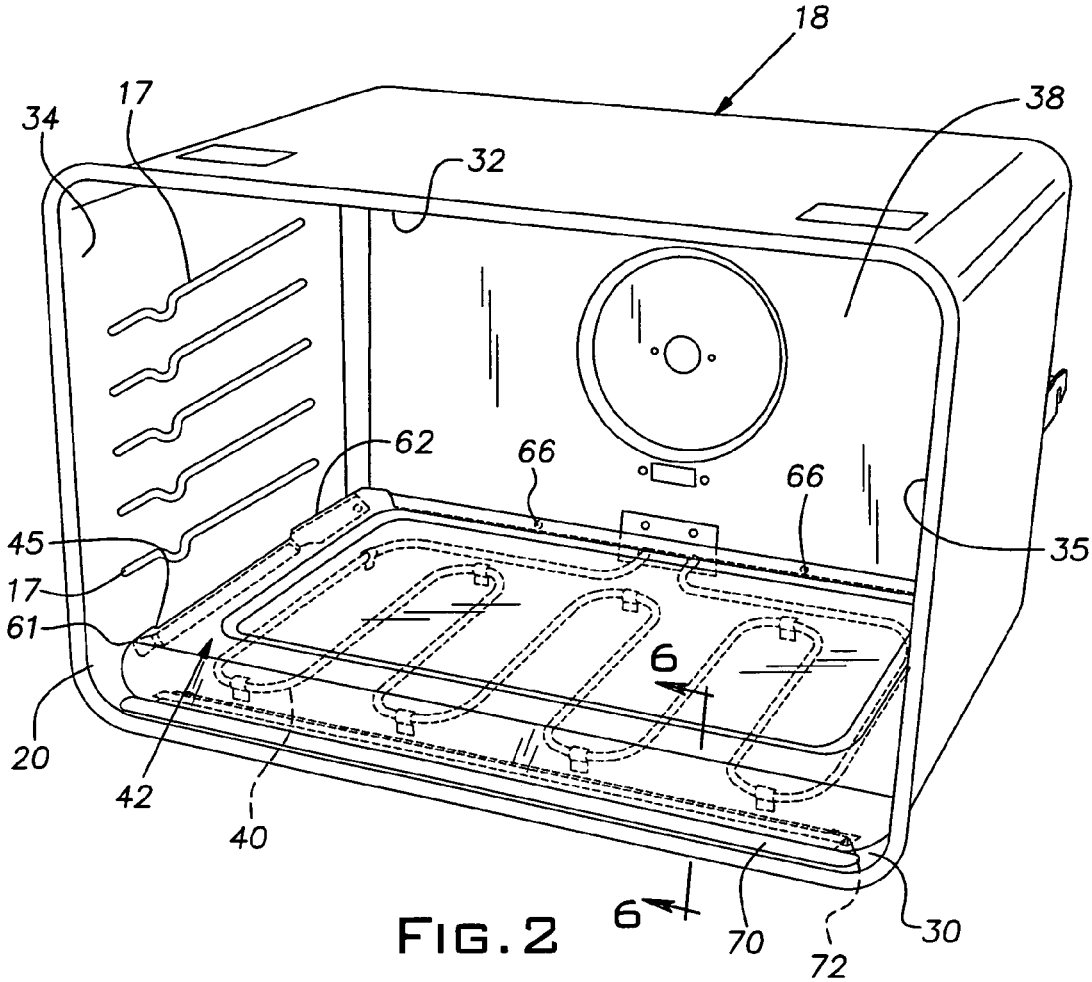
FIG. 2 is a somewhat schematic perspective view of the oven chamber and the shielding member of FIG. 1, illustrating in phantom lines the heating element that can be located beneath the shielding member.

In FIG. 2, the oven chamber 18 is shown as removed from the range 10 for the purpose of facilitating the description of the oven chamber. As shown in FIG. 2, the oven chamber 18 comprises a bottom wall 30 and a top wall 32. The oven chamber includes at least one side wall that joins the bottom wall and the top wall. In the embodiment of the invention shown in the drawings, the oven chamber 18 includes a first side wall 34 and a second side wall 35 as well as a rear wall 38 that joins the first and second side walls 34 and 35. Additionally, as has been noted, the oven chamber 18 has a frontal opening 20 that provides access to the interior of the oven chamber.

A heating element 40 is located within a first section of the oven chamber 18 between the bottom wall 30 of the oven chamber and the top wall 32 of the oven chamber. In the embodiment shown in the drawings, the heating element 40 is supported on the bottom wall 30 of the oven chamber and the two ends of the heating element extend through the rear wall 38 of the oven chamber so as to be suitably operatively connected to an electrical circuit in a manner familiar to those skilled in the art.

A shielding member, indicated generally at 42, is located within the oven chamber 18 between the first section of the oven chamber, where the heating element is in place, and the top wall 32 of the oven chamber. As best shown in FIG. 2, the shielding member 42 extends over the first section of the oven chamber, including the heating element 40, located therein. The shielding member 42 is made of a material, such as enameled steel, for example, that is essentially impervious to solid and liquid materials. As a result, the shielding member 42 shields the first section of the oven chamber 18, including the heating element 40 located therein, from cooking and baking releases occurring in a second sectin of the oven chamber above the shielding member. In the embodiment of the invention shown in the drawings, the second section of the oven chamber comprises that portion of the oven chamber where the supports 17 are located. As previously described, the supports 17 support cooking racks on which cooking ware containing food items are placed.

Figures 3, 4, 5:
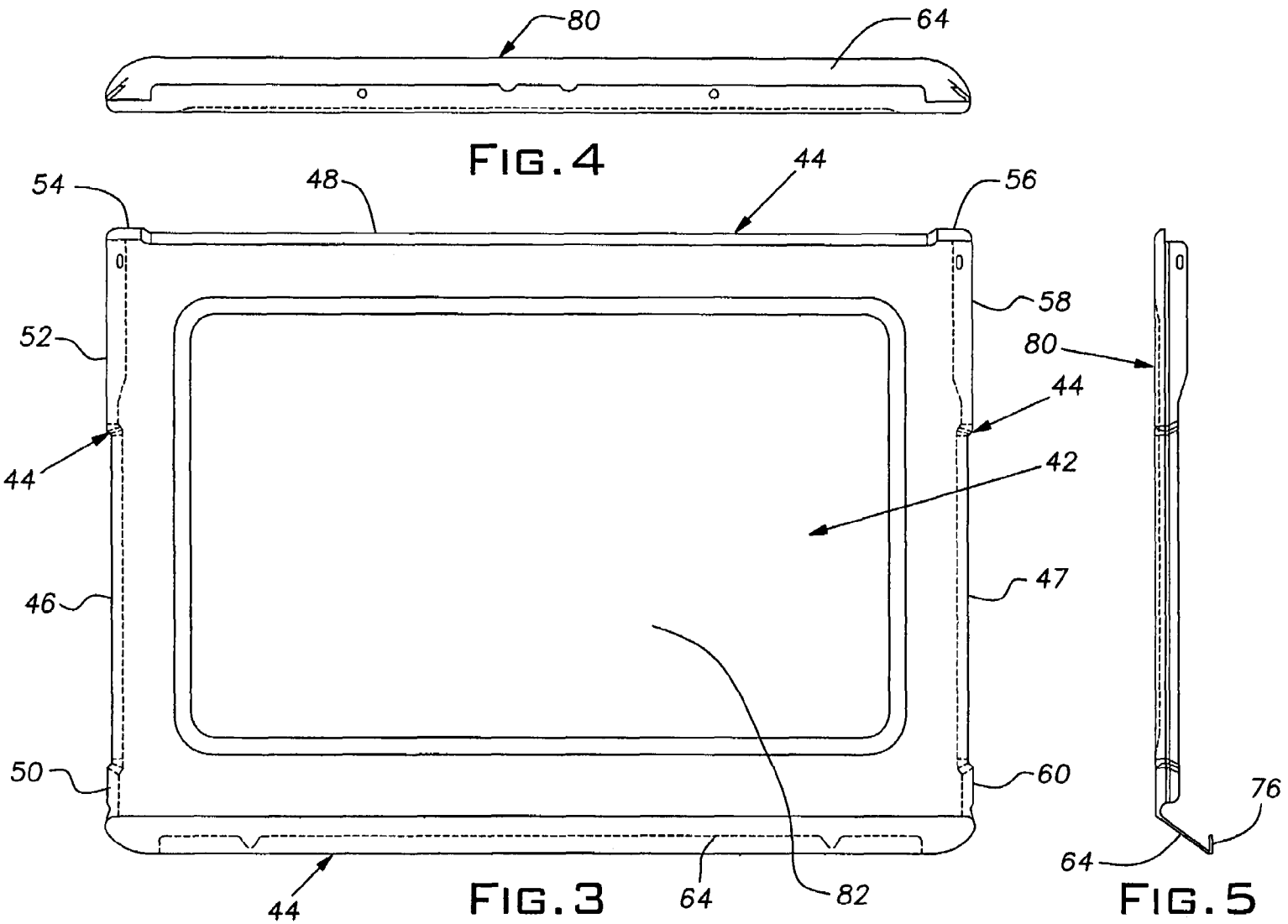
FIG. 3 is a top plan view of the shielding member of FIGS. 1 and 2.
FIG. 4 is a front elevational view of the shielding member of FIG. 3.
FIG. 5 is a side elevational view of the shielding member of FIG. 3.

As best illustrated in FIG. 3, the shielding member 42 has an outer boundary, indicated generally at 44. One or more first portions of the outer boundary 44 are spaced away from the at least one side wall of the oven chamber 18 by a first distance so as to form an open space between each of the one or more first portions of the outer boundary 44 of the shielding member 42 and the at least one side wall through which convective heat may pass from the heating element 40 to the second section of the oven chamber where the food items to be cooked are held. In the embodiment of the invention illustrated in the drawings, there is one first portion 46 of the outer boundary 44 of the shielding member 42 that is spaced away from the first side wall 34, another first portion 47 of the outer boundary 44 of the shielding member that is spaced away from the second side wall 35 and yet another first portion 48 of the outer boundary 44 of the shielding member 42 that is spaced away from the back wall 38 of the shielding member 42. As indicated above, the spaces that are formed between these first portions of the shielding member 42 and the respective walls of the oven chamber that are adjacent to the first portions of the shielding member allow for convective heat to pass from the heating element 40 to the second section of the cooking chamber where the food to be heated is placed. The space that exists between the one first portion 46 of the boundary 44 of the shielding member and the first wall 34 is indicated at 45 in FIG. 2. It will be understood that similar spaces exist between the one first portion 48 of the boundary 44 of the shielding member and the rear wall 38 of the oven chamber and between the one first portion 47 of the boundary 44 of the shielding member and the second side wall 35 of the oven chamber.

Again referring to FIG. 3, it can be seen that the shielding member 42 includes one or more second portions of the outer boundary 44 of the heating shield. The second portions of the outer boundary 44 are located in relation to the at least one side wall at a distance ranging from being in engagement with the at least one side wall to being spaced away from the at least one side wall a second distance that is less than the first distance by which the first portions of the outer boundary 44 of the shielding member are spaced away from the at least one side wall. More specifically as shown in FIG. 3, second portions 50 and 52 of the outer boundary 44 of the shielding member are spaced away from the first side wall 34, second portions 54 and 56 of the outer boundary 44 of the shielding member are spaced away from the rear wall 38 and second portions 58 and 60 of the outer boundary 44 of the shielding member are spaced away from the second side wall 35, so as to be out of engagement with the first side wall, the rear wall and the second side wall, respectively. But also, these second portions are not to be spaced away from those walls by a distance greater than the distance by which the first portions 46, 47 and 48 of the outer boundary 44 of the shielding member are spaced away from the first side wall, the second side wall and the rear wall, respectively. Thus, the first portions 46, 47 and 48 form respective notched sections along common edges of the outer boundary 44. The spaces that are formed between the second portions 50 and 52 of the outer boundary 44 of the shielding member and the first side wall 34 are indicated at 61 and 62. Similar spaces are present between the second portions 54 and 56 of the outer boundary 44 of the shielding member and the rear wall 38 and between the second portions 58 and 60 of the outer boundary 44 and the second side wall 35. As indicated above, however, these second portions of the outer boundary 44 of the shielding member need not be spaced from the walls of the oven chamber and can engage the walls of the oven chamber. In this regard, it has been determined that spacing the first portions 46, 47 and 48 of the outer boundary 44 of the shielding member a distance of about seven and two-tenths millimeters from respective walls of the oven chamber and spacing the second portions 50, 52, 54, 56, 58 and 60 of the outer boundary 44 of the shielding member a distance of about four millimeters from the walls of the oven chamber allow for the shielding member 42 to adequately shield the first section of the oven chamber, including the heating element 40, from discharges and releases that occur in the second section of the oven, while at the same time allowing for adequate convective heat to pass from the first section to the second section.

Figure 6:
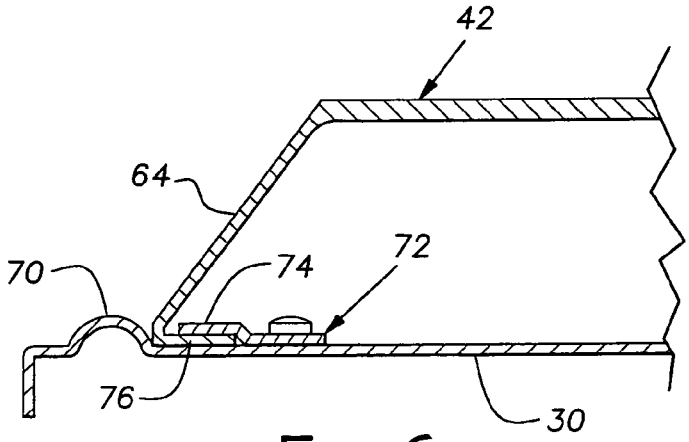
FIG. 6 is a cross-sectional view taken along lines 6-6 of FIG. 2 that illustrates certain details of the shielding member, the bracket and the abutment member.

For the purpose of at least partially supporting the shielding member 42 above the heating element 40, a portion 64 of the outer boundary 44 of the shielding member extends away from the remainder of the shielding member toward the bottom wall 30 of the oven chamber, as best seen in FIGS. 5 and 6, and rests on the bottom wall of the oven chamber, as best seen in FIG. 6, adjacent the frontal opening 20 of the oven chamber. In addition, a supporting component is located at the rear wall 38 of the oven chamber and a portion of the outer boundary 44 of the shielding member adjacent the rear wall 38 rests on the supporting component, also to maintain the shielding member above and out of contact with the heating element 40. In the embodiment of the invention shown in the drawings, the supporting component comprises support elements 66 such as, for example, shoulder screws or pins. The supporting component can comprise any type of a resting surface or shoulder element that extends from the rear wall 38 towards the interior of the oven chamber. In one embodiment, the resting surface can comprise the base of a U-shaped bracket, one leg of which is fastened to the rear wall 38.

According to the embodiment of the invention shown in the drawings, means are also provided to maintain the shielding member 42 in place over the heating element 40. Specifically, an abutment member 70 is located at the bottom wall 30 of the oven chamber adjacent the frontal opening 20 of the oven chamber. As shown in FIG. 6, the portion 64 of the outer boundary of the shielding member that is located adjacent the frontal opening of the oven chamber abuts the abutment member 70 so as to aid in the retention of the shielding member 42 in place within the oven chamber 18. Additionally, a bracket, indicated generally at 72, is secured to the bottom wall 30 of the oven chamber, as by fasteners, adjacent the frontal opening 20 of the oven chamber and inwardly of the oven chamber interior in relation to the abutment member 70 and also aids in the retention of the shielding member 42 in place within the oven chamber. The bracket 72 includes a flange 74, as best seen in FIG. 6, that is spaced above the bottom wall 30 of the oven chamber. The portion 64 of the outer boundary 44 of the shielding member includes a depending portion 76 that extends inwardly of the oven chamber into the space formed between the flange 74 of the bracket 72 and the bottom wall 30 of the oven chamber. Alternatively, the bracket 72 alone can be employed, without the abutment 70, for retaining the shielding member in place or only the abutment 70 can be used without the bracket 72. Additionally, both the abutment 70 and the bracket 72 can be eliminated and an alternative means can be provided to aid in retaining the shielding member 42 in place in the oven chamber.

A further feature of the shielding member concerns the convenient collection of cooking and baking releases and discharges that occur in the second section of the oven chamber where food is heated. Specifically, the shielding member includes an upper surface, indicated generally at 80 in FIG. 5 that faces the second section of the oven chamber where food is heated. A central portion 82 of the upper surface 80 of the shielding member is disposed at a lower level within the oven chamber than the remainder of the upper surface of the shielding member, whereby the cooking and baking releases and discharges occurring in the second section of the oven chamber tend to collect on the central portion 82 of the shielding member.

Although the invention has been described with respect to a specific embodiment, it will be recognized by those skilled in the art that the invention can be practiced with modifications that are within the spirit and scope of the claims that follow.

What is claimed is:

1. An oven chamber comprising:

a bottom wall, a top wall and at least one side wall;

a heating element located within a first section of the oven chamber between the bottom wall of the oven chamber and the top wall of the oven chamber; and a shielding member located within the oven chamber between the first section of the oven chamber and the top wall of the oven chamber and extending over the first section of the oven chamber, including the heating element located therein, the shielding member being essentially impervious to solid and liquid materials so as to shield the first section of the oven chamber, including the heating element located therein, from cooking and baking releases occurring in a second section of the oven chamber above the shielding member, the shielding member having an outer boundary, at least two first portions of the outer boundary of the shielding member being spaced away from the at least one side wall of the oven chamber by a first distance so as to form an open space between each of the at least two first portions of the outer boundary of the shielding member and the at least one side wall through which convective heat may pass from the heating element to the second section of the oven chamber, and one or more second portions of the outer boundary of the shielding member being located in relation to the at least one side wall at a distance ranging from being in engagement with the at least one side wall to being spaced away from the at least one side wall a second distance that is less than the first distance, wherein the at least two first portions of the outer boundary of the shielding member and the one or more second portions of the outer boundary of the shielding member are positioned along a common edge of the shielding member, and wherein at least one of the second portions of the outer boundary is positioned between two first portions of the outer boundary along a common edge of the shielding member to form a notched section in the outer boundary of the shielding member.

2. The oven chamber of claim 1 wherein:

at least one of the one or more first portions of the outer boundary of the shielding member is spaced away from the at least one side wall of the oven chamber by a distance of about seven and two-tenths millimeters.

3. The oven chamber of claim 2 wherein:

at least one of the one or more second portions of the outer boundary of the shielding member is spaced away from the at least one side wall of the oven chamber by a distance of about four millimeters.

4. The oven chamber of claim 1 wherein:

the oven chamber includes first and second side walls; and at least one of the one or more first portions of the outer boundary of the shielding member is spaced away from the first side wall of the oven chamber so as to form an open space between the at least one of the one or more first portions of the outer boundary of the shielding member and the first side wall through which convective heat may pass from the heating element to the second section of the oven chamber, and at least one of the one or more first portions of the outer boundary of the shielding member is spaced away from the second side wall of the oven chamber so as to form an open space between the at least one of the one or more first portions of the outer boundary of the shielding member and the second side wall through which convective heat may pass from the heating element to the second section of the oven chamber.

5. The oven chamber of claim 4 wherein:

the oven chamber includes a rear wall joining the first and second side walls.

6. The oven chamber of claim 5 wherein:

at least one of the one or more first portions of the outer boundary of the shielding member is spaced away from the rear wall of the oven chamber so as to form an open space between the at least one of the one or more first portions of the outer boundary of the shielding member and the rear wall through which convective heat may pass from the heating element to the second section of the oven chamber.

7. The oven chamber of claim 6 wherein:

at least one of the one or more first portions of the outer boundary of the shielding member is spaced away from a wall of the oven chamber by a distance of about seven and two-tenths millimeters.

8. The oven chamber of claim 7 wherein:

at least one of the one or more second portions of the outer boundary of the shielding member is spaced away from a wall of the oven chamber by a distance of about four millimeters.

9. The oven chamber of claim 6 wherein:

the oven chamber has a frontal opening that provides access to the interior of the oven chamber; and a portion of the outer boundary of the shielding member is located adjacent the frontal opening of the oven chamber and extends away from the remainder of the shielding member toward the bottom wall of the oven chamber and rests on the bottom wall of the oven chamber so as to at least partially support the shielding member above the heating element.

10. The oven chamber of claim 9 wherein:

a bracket is secured to the bottom wall of the oven chamber adjacent to and inwardly of the frontal opening of the oven chamber, the bracket including a flange that is spaced above the bottom wall of the oven chamber; and the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element includes a depending portion that extends inwardly of the oven chamber into the space formed between the flange of the bracket and the bottom wall of the oven chamber.

11. The oven chamber of claim 9 wherein:

an abutment member is located at the bottom wall of the oven chamber adjacent the frontal opening of the oven chamber; and the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element abuts the abutment member whereby the shielding member is retained in place within the oven chamber.

12. The oven chamber of claim 11 wherein:

a supporting compartment component is located at the rear wall of the oven chamber; and a portion of the outer boundary of the shielding member adjacent the rear wall of the oven chamber rests on the supporting component.

13. The oven chamber of claim 11 wherein:

a bracket is secured to the bottom wall of the oven chamber adjacent the frontal opening of the oven chamber and inwardly of the oven chamber interior in relation to the abutment member, the bracket including a flange that is spaced above the bottom wall of the oven chamber; and the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element includes a depending portion that extends inwardly of the oven chamber into the space formed between the flange of the bracket and the bottom wall of the oven chamber.

14. The oven chamber of claim 13 wherein:

a supporting component is located at the rear wall of the oven chamber; and a portion of the outer boundary of the shielding member adjacent the rear wall of the oven chamber rests on the supporting component.

15. The oven chamber of claim 14 wherein:

at least one of the one or more first portions of the outer boundary of the shielding member is spaced away from the respective side wall of the oven chamber by a distance of about seven and two-tenths millimeters.

16. The oven chamber of claim 15 wherein:

the shielding member includes an upper surface that faces the second section of the oven chamber and a central portion of the upper surface of the shielding member is disposed at a lower level within the oven chamber than the remainder of the upper surface of the shielding member, whereby the cooking and baking releases occurring in the second section of the oven chamber tend to collect on the central portion of the upper surface of the shielding member.

17. The oven chamber of claim 15 wherein:

at least one of the one or more second portions of the outer boundary of the shielding member is in engagement with the respective side wall of the oven chamber.

18. The oven chamber of claim 1 wherein:

the oven chamber has a frontal opening that provides access to the interior of the oven chamber; and a portion of the outer boundary of the shielding member is located adjacent the frontal opening of the oven chamber and extends away from the remainder of the shielding member toward the bottom wall of the oven chamber and rests on the bottom wall of the oven chamber so as to at least partially support the shielding member above the heating element.

19. The oven chamber of claim 18 wherein:

a bracket is secured to the bottom wall of the oven chamber adjacent to and inwardly of the frontal opening of the oven chamber, the bracket including a flange that is spaced above the bottom wall of the oven chamber; and the portion of the outer boundary of the shielding member that is located adjacent the frontal opening of the oven chamber and extends away from the remainder of the shielding member toward the bottom wall of the oven chamber so as to at least partially support the shielding member above the heating element includes a depending portion that extends inwardly of the oven chamber into the space formed between the flange of the bracket and the bottom wall of the oven chamber.

20. The oven chamber of claim 18 wherein:

an abutment member is located at the bottom wall of the oven chamber adjacent the frontal opening of the oven chamber; and the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element abuts the abutment member whereby the shielding member is retained in place within the oven chamber.

21. The oven chamber of claim 20 wherein:

a bracket is secured to the bottom wall of the oven chamber adjacent the frontal opening of the oven chamber and inwardly of the oven chamber interior in relation to the abutment member, the bracket including a flange that is spaced above the bottom wall of the oven chamber; and the portion of the outer boundary of the shielding member that is located adjacent the frontal opening of the oven chamber and extends away from the remainder of the shielding member toward the bottom wall of the oven chamber and rests on the bottom wall of the oven chamber so as to at least partially support the shielding member above the heating element includes a depending portion that extends inwardly of the oven chamber into the space formed between the flange of the bracket and the bottom wall of the oven chamber.

22. The oven chamber of claim 21 wherein:

at least one of the one or more first portions of the outer boundary of the shielding member is spaced away from the respective side wall of the oven chamber by a distance of about seven and two-tenths millimeters.

23. The oven chamber of claim 22 wherein:

at least one of the one or more second portions of the outer boundary of the shielding member is in engagement with the respective side wall of the oven chamber.

* * * * *